US006030015A

United States Patent [19]

Fujikawa et al.

[11] Patent Number: 6,030,015

[45] Date of Patent: Feb. 29, 2000

[54] BELT HOIST HAVING IMPROVED BELT-HOOK ASSEMBLY

[75] Inventors: Masaru Fujikawa; Koji Saai, both of Osaka, Japan

[73] Assignee: Elephant Chain Block Co., Ltd., Osaka, Japan

[21] Appl. No.: 08/891,825

[22] Filed: Jul. 14, 1997

[30] Foreign Application Priority Data

Jul. 31, 1996 [JP] Japan ..... 8-202500

[51] Int. Cl.[7] ..... B66D 1/34

[52] U.S. Cl. ..... 294/82.11; 24/197; 24/265 H

[58] Field of Search ..... 294/74, 82.1, 82.11, 294/82.15; 24/37, 68 CD, 68 A, 68 E, 69 CT, 69 SB, 165, 193, 194, 196–198, 200, 265 R, 265 H

[56] References Cited

U.S. PATENT DOCUMENTS

| | | | |
|---|---|---|---|
| 3,131,450 | 5/1964 | Zinkel | 24/197 |
| 3,222,743 | 12/1965 | Alofs | 24/165 |
| 4,365,391 | 12/1982 | Chapalain | 24/200 X |
| 4,641,875 | 2/1987 | Speich | 294/82.11 |

FOREIGN PATENT DOCUMENTS

| | | | |
|---|---|---|---|
| 0 091 992 | 10/1983 | European Pat. Off. . | |
| 682 482 | 10/1939 | Germany . | |
| 3235299 | 3/1984 | Germany | 294/82.11 |
| 33 44 485 | 4/1985 | Germany . | |
| 90 10 180 | 2/1991 | Germany . | |
| 1 381 344 | 1/1975 | United Kingdom . | |

*Primary Examiner*—Johnny D. Cherry
*Attorney, Agent, or Firm*—Dickstein Shapiro Morin & Oshinsky LLP

[57] ABSTRACT

A belt hoist capable of firmly joining a hook to a free end portion of a belt, although the hook holds the free end portion of the belt in a clipping manner. The hook includes a support rod around which the belt is wound and a holding portion for holding the support rod in sandwich, and the free end portion of the belt includes a first coiling portion wound around the support rod in direct contact therewith and a second coiling portion wound around the first coiling portion of the belt in direct contact therewith, with the first and second coiling portions of the belt being wound in opposite directions to each other.

4 Claims, 7 Drawing Sheets

BELT HOIST HAVING IMPROVED BELT-HOOK ASSEMBLY

BACKGROUND OF THE INVENTION

1. Field of the Invention

The present invention relates to a belt hoist wherein a hook is joined to a free end portion of a belt wound around a winding member so that a load hooked with the hook can be raised up or lowered down or dragged.

2. Description of the Prior Art

A double-hung type belt hoist wherein a free end portion of a belt wound around a winding member is fixed to a hoist body supporting the winding member thereto and a hook is supported via a pulley so as to be freely movable along a portion of the belt on the loaded side extending between the fixed free end portion and a coiled portion of the belt in a longitudinal direction of the belt has already been proposed. However, a single-hung type belt hoist wherein the hook is joined to the free end portion of the belt wound around the winding member has not yet been successfully developed.

In the single-hung type belt hoist, the mere holding of the free end portion of the belt to the hook in a clipping manner results in occurrence of a slippage at the free end portion of the belt by a load acting on the loaded side of the belt, thus causing a problem that the free end portion of the belt is easy to fall out from a holding portion of the hook.

SUMMARY OF THE INVENTION

Accordingly, it is the primary object of the present invention to provide a belt hoist which enables a hook to be firmly connected to a free end portion of a belt, although the free end portion of the belt is inserted in and held in a clipping manner by the hook.

A belt hoist according to the invention comprises a belt having a free end portion and a hook connected to a free end portion of the belt, the hook comprising a support rod around which the free end portion of the belt is wound and a holding portion for holding the support rod in sandwich, and the free end portion of the belt comprising a first coiling portion wound around the support rod in direct contact with it and a second coiling portion wound around the first coiling portion of the belt in direct contact with it, with the first and second coiling portions of the belt being wound in opposite directions.

According to this invention, the first coiling portion of the belt is wound on the support rod in direct contact with it and further the second coiling portion of the belt is wound on the first coiling portion of the belt in direct contact with it. With the first and second coiling portions of the belt wound around the support rod in the opposite directions, the support rod is held in sandwich or in a clipping manner by the holding portions. This enables the first coiling portion and the second coiling portion to be both strung in a direction of tightening the support rod by a load applied to the belt. Thus, the support rod can be coiled double tightly by the first and second coiling portions of the belt to prevent the free end of the belt from falling out from the hook, thus achieving a firm connection of the hook to the free end portion of the belt.

Preferably, the first coiling portion and the second coiling portion are adapted to be continuous with each other through a turn-up portion. By virtue of the turn-up portion, the coiling direction of the first coiling portion and that of the second coiling portion can be made opposite to each other easily.

Further, it is desirable that the belt further comprises first and second overlapping portions continuous to both end portions of the first coiling portion and overlapping each other; and third and fourth overlapping portions continuous to both end portions of the second coiling portion and overlapping an outside surface of the first overlapping portion and an outside surface of the second overlapping portion, respectively, the second overlapping portion and the fourth overlapping portion being adapted to be continuous with each other through the turn-up portion.

The provision of the first through fourth overlapping portions yields the advantage that the joint of the hook to the belt can be strengthened by fourfold overlap of the first through fourth overlapping portions, together with the double tight coiling of the support rod by the first and second coiling portions.

Further, it is preferable that the holding portion comprises a first holding portion for holding the first through fourth overlapping portions in sandwich and a second holding portion for holding the support rod in sandwich around which the first and second coiling portions are wound.

This construction enables the joint of the hook to the belt to be further strengthened by holding the first through fourth overlapping portions in sandwich by the first holding portion, in addition to holding the support rod in sandwich by the second holding portion.

BRIEF DESCRIPTION OF THE DRAWINGS

The invention will now be described with reference to the accompanying drawings wherein.

DETAILED DESCRIPTION OF THE PREFERRED EMBODIMENT

Referring now to the accompanying drawing figures, an example of the preferred embodiment of the invention is described below. It is to be understood, however, that the scope of the invention is by no means limited to the illustrated embodiment.

Figure 5:
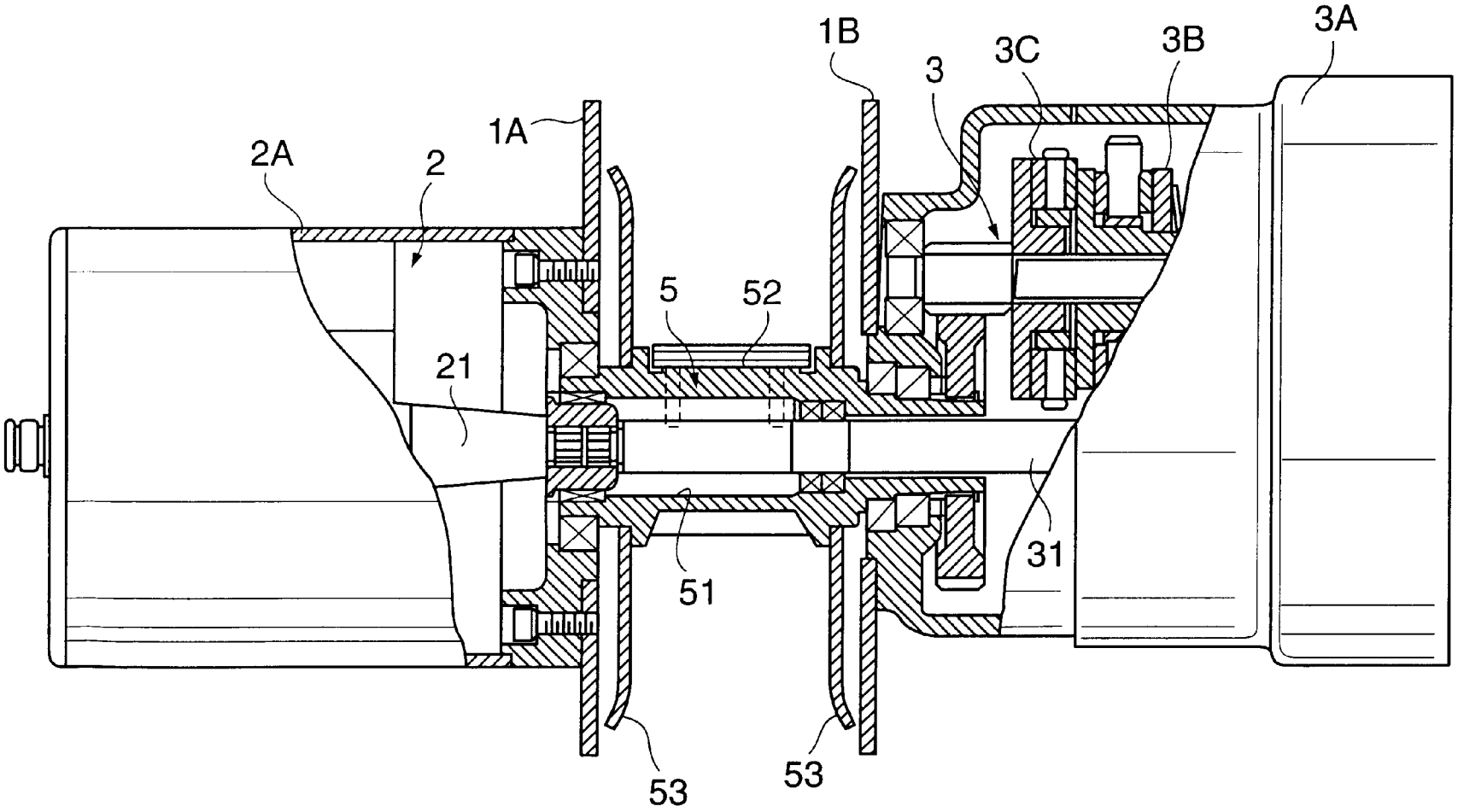
FIG. 5 is a partially broken, plan view of the belt hoist.
Figure 6:
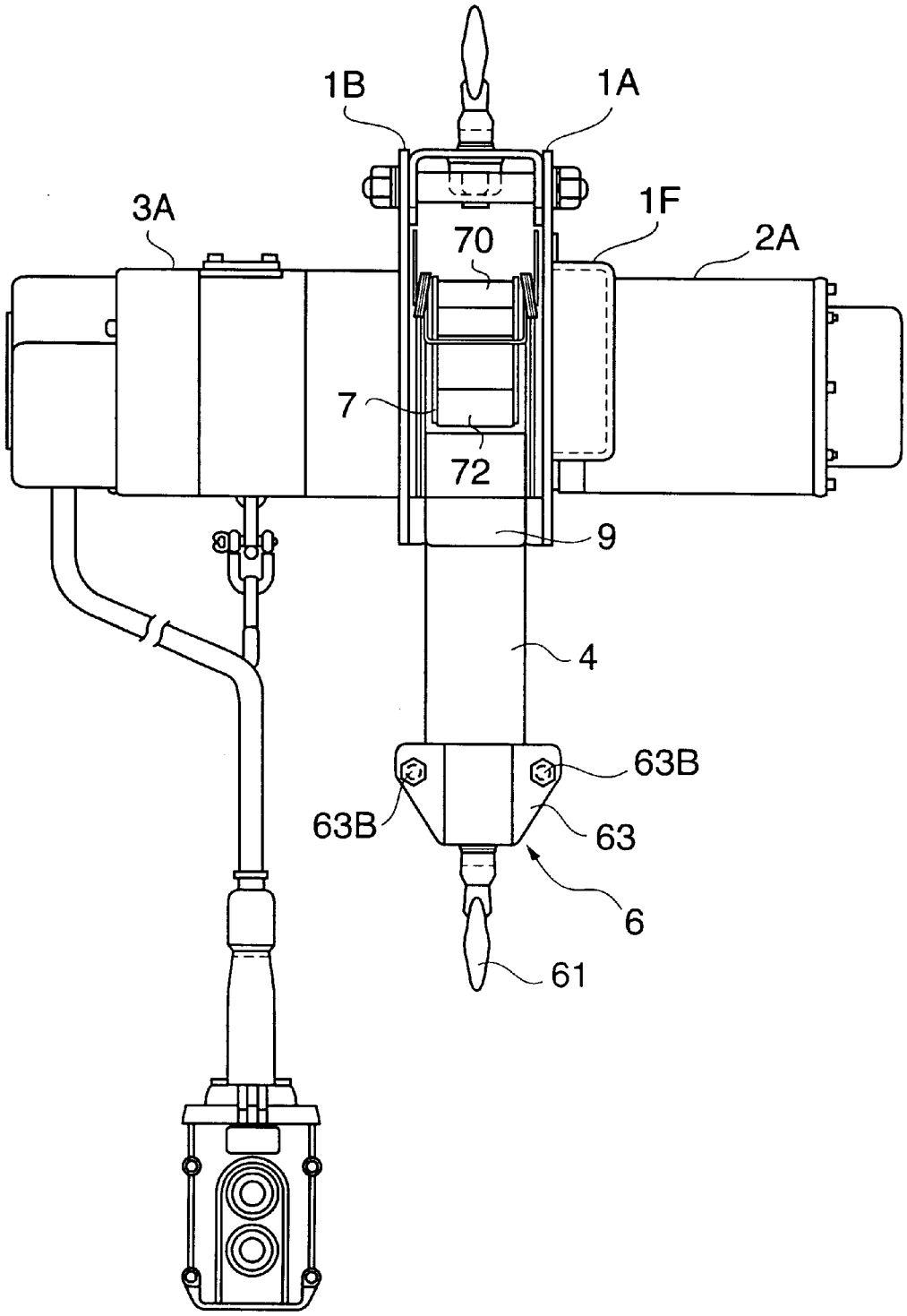
FIG. 6 is a rear view showing the entire structure of the belt hoist.

A belt hoist shown in FIGS. 5 and 6 comprises a pair of spaced apart, opposing first and second side plates 1A, 1B and a cylindrical winding member 5 having a shaft insertion bore 51 at the center thereof and rotatably supported between the pair of first and second side plates 1A, 1B via a pair of bearings. In the shaft insertion bore 51 of the winding member 5, a drive shaft 31 is rotatably supported via a pair of bearings. At an outside of the first side plate 1A, a motor 2 having a motor shaft 21 connected with the drive shaft 31 and capable of rotating in a normal direction and in a reverse direction is disposed. The motor 2 forms a driving means. At an outside of the second side plate 1B, a reduction gear mechanism 3, including therein an over-loading prevent mechanism 3B and a mechanical brake 3C, for reducing rotational speed of the drive shaft 31 to a lower rotational speed to be transmitted to the winding member 5 is disposed.

The drive of the motor 2 drives the winding member 5 to be rotated in the normal direction or in the reverse direction through the drive shaft 31 and the reduction gear mechanism 3. The motor 2 is covered with a cover 2A mounted on the first side plate 1A, and the reduction gear mechanism 3 is covered with a cover 3A mounted on the second side plate 1B.

The winding member 5 has a winding periphery 52 on which a flat belt 4 is wound and disc-like winding flanges 53, 53 projecting from the winding periphery 52 at the opposite ends thereof. The flat belt 4 has one end fixed to the winding periphery 52 and a free end portion to which a hook 6 is detachably joined.

Figure 1:
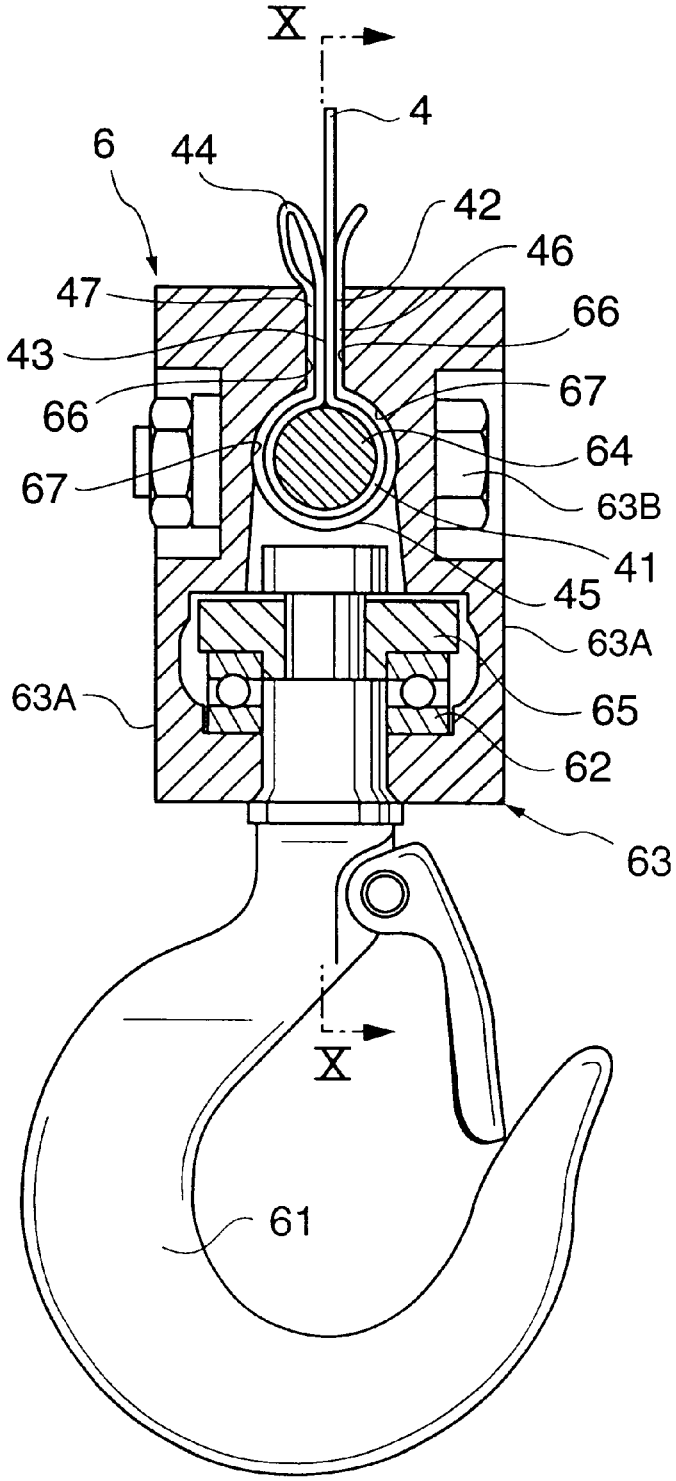
FIG. 1 is a sectional view of the hook connected to the free end portion of the belt of the belt hoist according to the invention.
Figure 2:
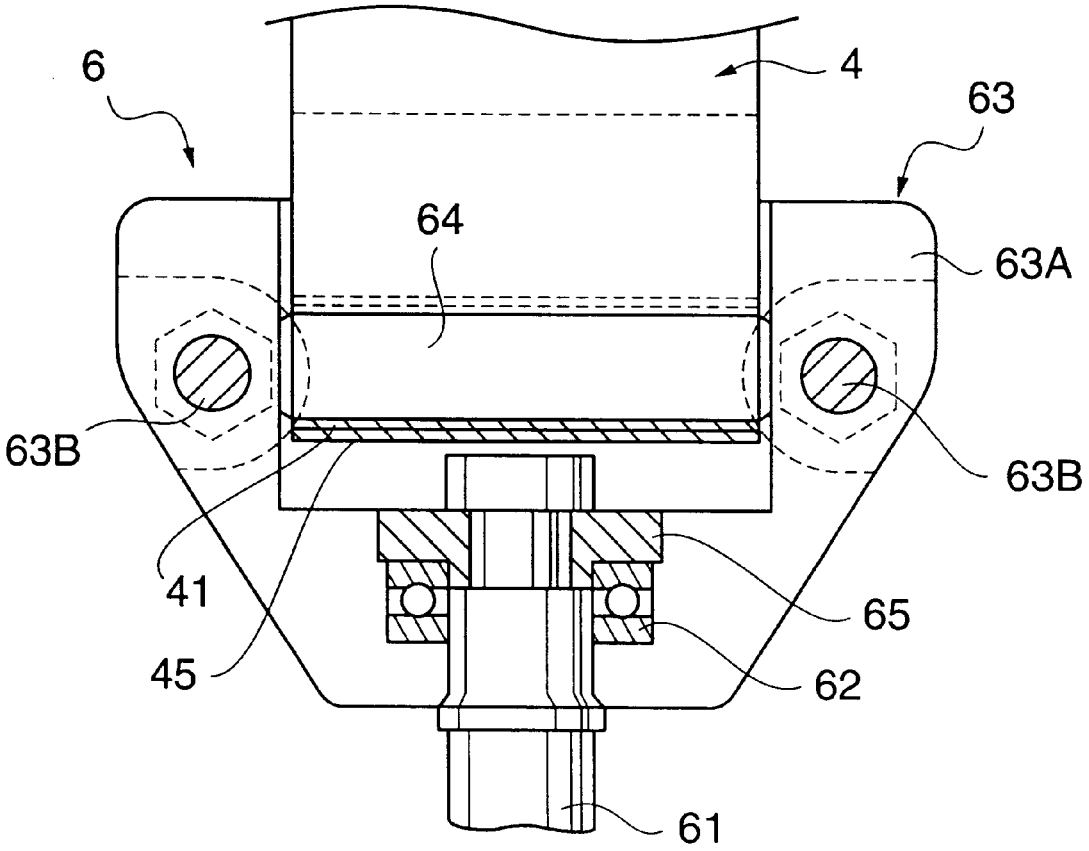
FIG. 2 is a sectional view taken on line X—X of FIG. 1.

The hook 6 comprises a generally J-shaped hook body 61, a hook's joint 63 in which the hook body 61 is rotatably held at the basal end thereof via a thrust bearing 62, and a support rod 64 around which the free end portion of the belt 4 is wound, as shown in FIGS. 1 and 2. The thrust bearing 62 and a retaining ring 65 therefor are carried by the hook body 61 at the basal end thereof.

The hook's joint 63 comprises two half joint bodies 63A, 63A, and two fastening bolts 63B to join the joint bodies 63A, 63A together, abutting their confronting surfaces to each other. The thrust bearing 62 and the retaining ring 65 are housed and held in between the joint bodies 63A, 63A at lower ends thereof. Further, each of the joint bodies 63A, 63A is provided at its upper inside portion with first and second holding portions 66, 67. The first holding portions 66 are recessed with respect to the confronting surfaces of the joint bodies and flatted to be contactable with the free end portion of the belt. The second holding portions 67 are curved inwards from lower ends of the first holding portions 66 to hold the support rod 64. When the joint bodies 63A are joined together by tightening the fastening bolts 63B, the supporting rod 64 is held in sandwich or in a clipping manner by the second holding portions.

The free end portion of the belt 4 comprises a first coiling portion 41 wound around the support rod 64 in direct contact therewith, first and second overlapping portions 42, 43 extending continuously beyond both end portions of the first coiling portion 41, a second coiling portion 45 extending continuously to the second overlapping portion 43 through a turn-up portion 44 so that it can be coiled in a direction opposite to the winding direction of the first coiling portion 41 to be wound around the first coiling portion 41 in direct contact therewith, and third and fourth overlapping portions 46, 47 extending continuously beyond both end portions of the second coiling portion 45 to overlap the first and second overlapping portions 42, 43. An outer surface of the second coiling portion 45 is contacted with the second holding portion 67 so that the support rod 64 can be held in sandwich or in a clipping manner via the second coiling portion 45 and the first coiling portion 41, and further the third and fourth overlapping portions 46, 47 are contacted with and held in sandwich or in a clipping manner by the first holding portion 66.

Figure 3:
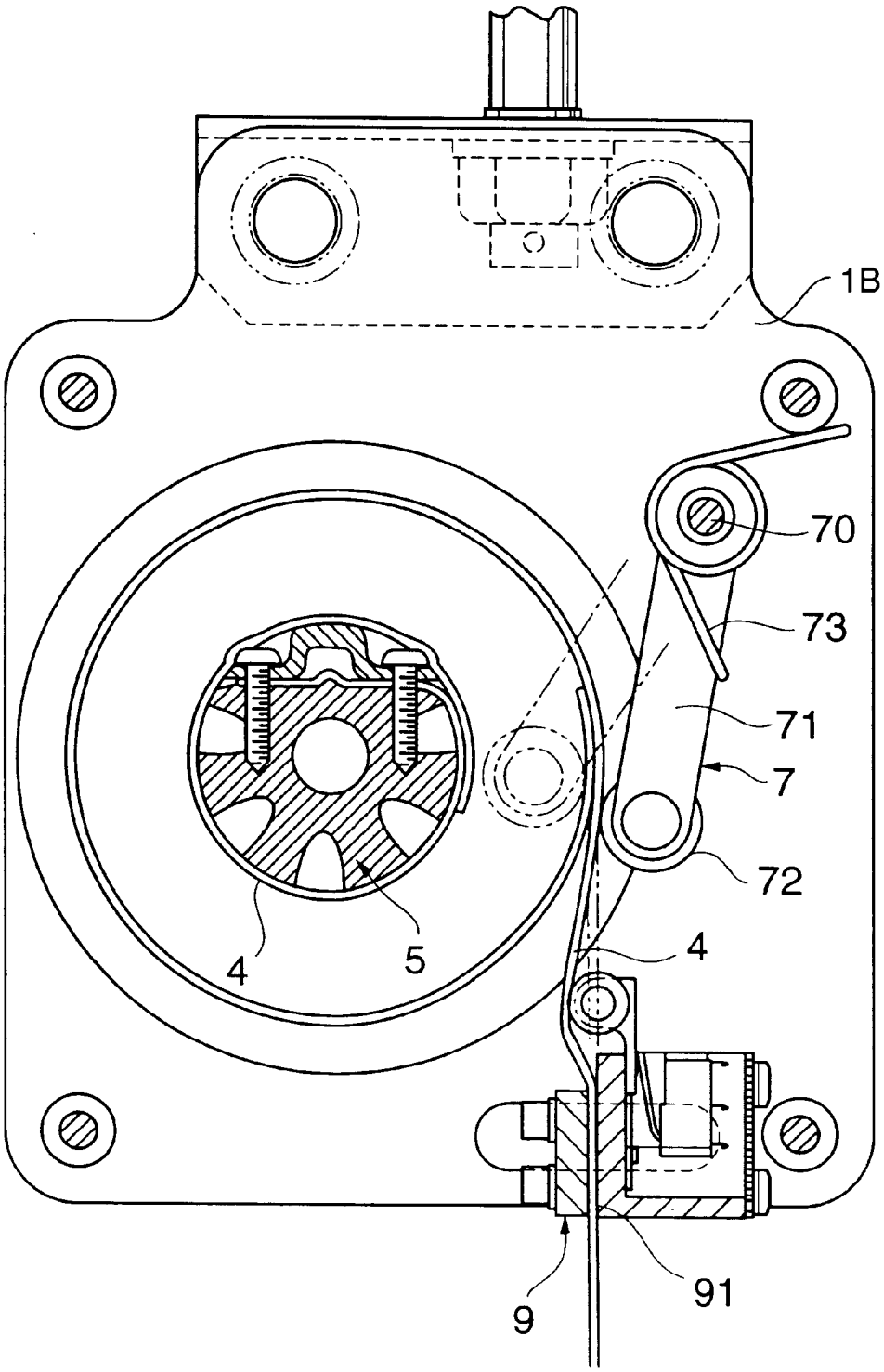
FIG. 3 is a partly omitted, vertical sectional view of the belt hoist on the winding member side only.
Figure 4:
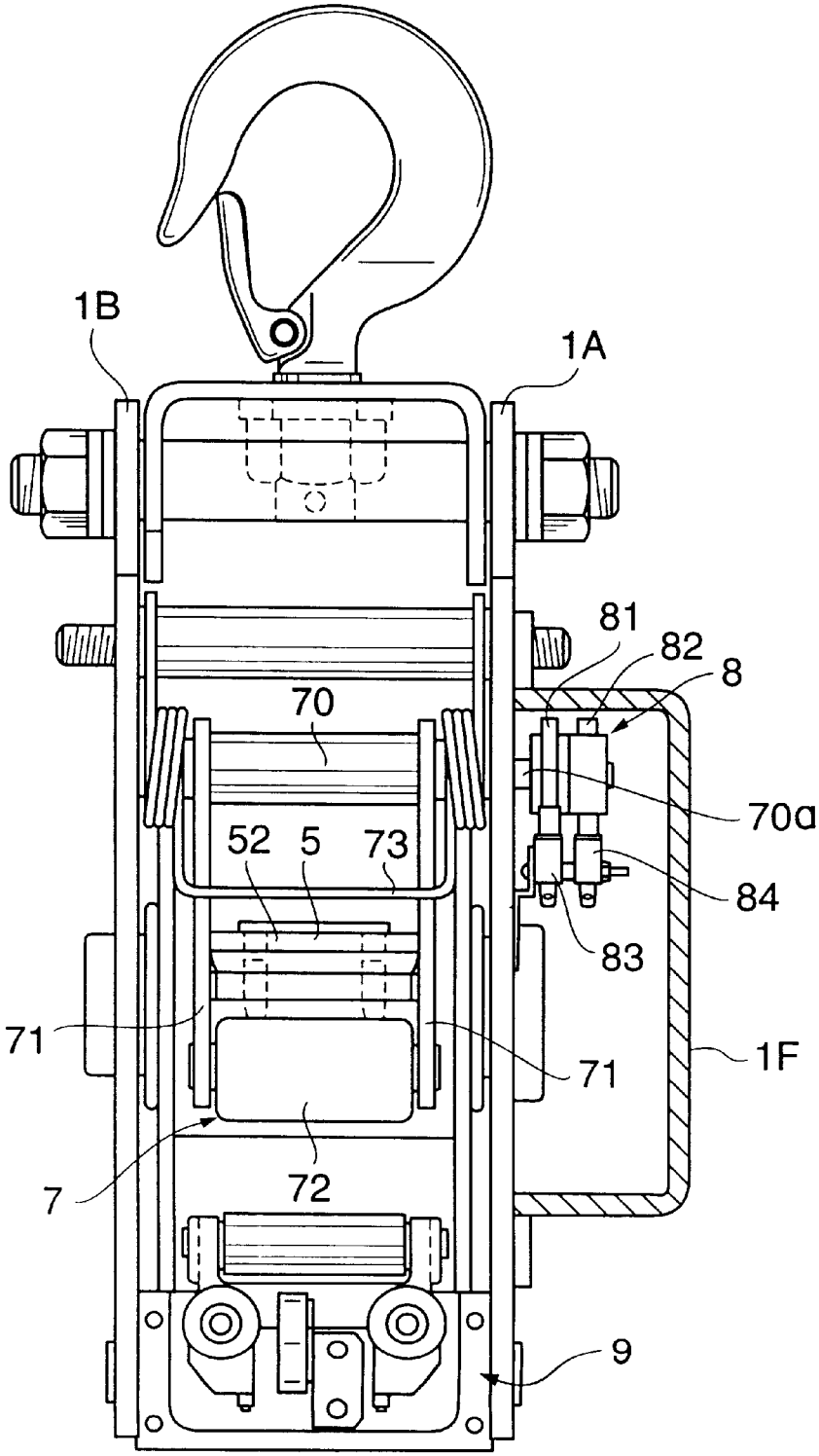
FIG. 4 is a partly cutaway, rear view of the same.

In the embodiment shown in FIGS. 3 and 4, a random coil preventing member 7 for normally pressing the belt 4 against the winding periphery 52 of the winding member 5 to prevent random coil of the belt 4 is swingably supported on a pivot 70 between the first and second side plates 1A, 1B. Also, a control means 8 is provided for controlling the drive of the motor 2 by swinging motion of the random coil preventing member 7 in response to changes in circle diameter of the belt 4 wound around the winding member 5. Further, a belt guide 9 with a belt guide bore 91 for allowing the belt 4 to freely pass therethrough is disposed below the random coil preventing member 7 in such a manner as to be movable in the same direction as the swinging direction of the random coil preventing member 7.

The random coil preventing member 7 comprises a pair of spaced apart, opposing arms 71, 71 which are mounted on the pivot 70 rotatably supported between the first and second side plates 1A, 1B; a rotary element 72 composed of a roller which is rotatably supported to the arms 71 at the front end portion thereof via bearing means and is contactable with the belt 4; and a biasing spring 73 for biasing the arm 71 toward the outer periphery of the winding member 5 so that the rotary element 72 can be normally pressed against the belt 4.

The control means 8 is provided in the following way. One lengthwise end portion 70*a* of the pivot 70 is projected outward from the side plate 1A. First and second protrusions 81, 82, each being formed by protruding one end portion of a boss having a fitting bore outward, are arranged on the projected end portion 70*a* with a specified phase difference in the circumferential direction and are secured thereto with screws so as to be changeable in position. As depicted in a two-dot chain line in FIG. 3, at positions near the projected end portion 70*a* and on swinging paths along which the first and second protrusions 81, 82 movable in response to the turning of the pivot 70 are swung, first and second detection switches 83, 84 are so arranged as to be adjustable in position, respectively. The first detection switch 83, which is formed by a limit switch and the like, is brought into contact with the first protrusion 81 to stop the drive of the motor 2 when length of the belt 4 wound around the winding member 5 decreases with the unwinding of the belt 4 and circle diameter of the belt 4 decreases below a specified circle diameter. The second detection switch 84, which is formed by a limit switch and the like, is brought into contact with the second protrusion 82 to stop the drive of the motor 2 when the length of the belt 4 wound around the winding member 5 increases with the winding of the belt 4 and the circle diameter of the belt 4 increases over a specified circle diameter. In the illustrated embodiment, at the outside of the side plate 1A, a cover 1F for covering the protrusions 81, 82 and the detection switches 83, 84 is detachably attached to the side plate 1A with fastening screws, as shown in FIG. 4.

Next, operation of this constructed belt hoist is described below.

The belt 4, when wound onto or unwound from the winding member 5, is guided by the belt guide 9, passing through the belt guide bore 91 of the belt guide 9. With the winding or unwinding of the belt 4 onto or from the winding member 5, a load hooked with the hook 6 fixedly connected to the free end portion of the belt 4 is raised, lowered or dragged.

At the free end portion of the belt 4 to which the hook 6 is joined, the support rod 64 is held in sandwich by the holding portion 67 in the condition in which the first coiling portion 41 is wound around the support rod 64 in direct contact therewith, and further a portion of the free end portion extending from the first coiling portion 41 is turned down at the turn-up portion 44 so as to be wound around the second coiling portion 45 in direct contact therewith. The first and second coiling portions 41, 45 are coiled around the support rod 64 in the opposite directions. As a result of this, the first coiling portion 41 and the second coiling portion 45 are strung in a direction of tightening the support rod 64 by the load applied to the belt 4. This can provide the result that the support rod 64 can be coiled double tightly by the first and second coiling portions 41, 45 of the belt to prevent the free end portion of the belt from falling out from the hook. Thus, a firm connection of the hook to the free end portion of the belt can be achieved.

Further, the provision of the turn-up portion 44 provides the advantage that the coiling direction of the first coiling portion 41 and that of the second coiling portion 45 can be made opposite to each other easily. Also, the provision of the first through fourth overlapping portions 42, 43, 46, 47 yields the advantage that the joint of the hook 6 to the belt 4 can be strengthened by fourfold overlap of the first through fourth overlapping portions 42, 43, 46, 47, together with the double tight coiling of the support rod 64 by the first and second coiling portions 41,45.

Further, the joint of the hook 6 to the belt is further strengthened by holding the first through fourth overlapping portions 42, 43, 46, 47 in sandwich at the first holding portions 66, in addition to holding the support rod 64 in sandwich at the second holding portions 67.

In addition, the third and fourth overlapping portions 46, 47 of the free end portion of the belt, which are positioned outside and are contacted with the first holding portions 66 of the joint bodies 63A, 63A, as shown in FIG. 1, serve to protect a load-applying portion of the belt 4 extending between the hook 6 and the winding member 5 from contacting with the hook's joint 63. This can provide the advantage that the belt 4 can be well protected from being worn out by contact with the hook's joint 63.

Figure 7:
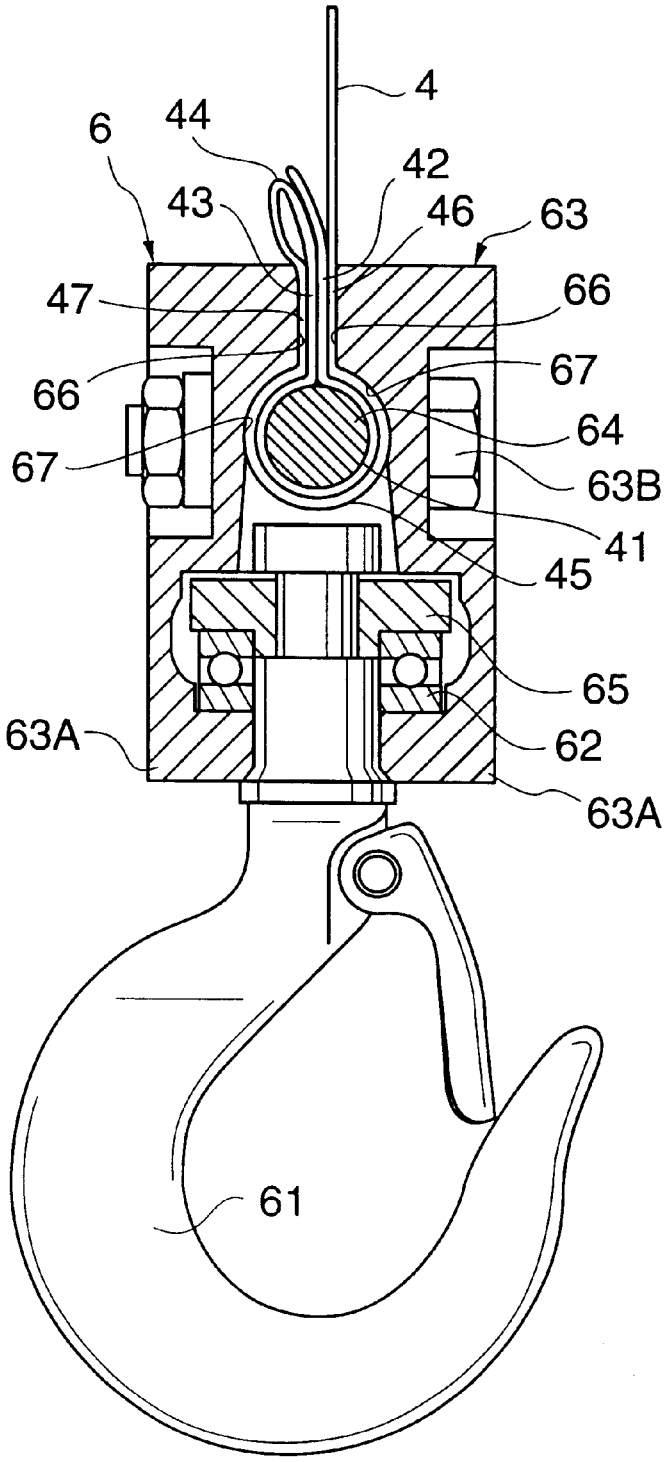
FIG. 7 is a sectional view of another embodiment corresponding to FIG. 1.

The embodiment described above, wherein the second coiling portion 45 is provided at a nearer side to the free end of the belt 4, and the first coiling portion 41 is provided at a further side therefrom, may be modified such that the first coiling portion 41 is provided at a nearer side to the free end of the belt, and the second coiling portion 45 is provided at a further side therefrom, as shown in FIG. 7. In this modification also, the support rod 64 is held in sandwich via the first coiling portion 41 and the second coiling portion 45 whose outer surface is contacted with the second holding portions 67, and further the third and fourth overlapping portions 46, 47 are contacted with and held in sandwich by the first holding portions 66, as in the case of the FIG. 1 embodiment.

What is claimed is:

1. A belt hoist comprising a belt having a free end portion and a hook connected to said free end portion of said belt, said hook comprising a support rod around which said free end portion of said belt is wound and a holding portion for holding said support rod in sandwich, and said free end portion of said belt comprising a first coiling portion wound around said support rod in direct contact with said support rod and a second coiling portion wound around said first coiling portion of said belt in direct contact with said first coiling portion, said first and second coiling portions of said belt being wound in opposite directions forming a twofold overlap, wherein the first coiling portion and the second coiling portion are continuous with each other through a turn-up portion, and wherein said belt further comprises first and second overlapping portions continuous to a first end portion and a second end portion of the first coiling portion and overlapping each other, and third and fourth overlapping portions continuous to a first end portion and a second end portion of the second coiling portion and overlapping an outside surface of the first overlapping portion and an outside surface of the second overlapping portion, respectively, the second overlapping portion and the fourth overlapping portion being continuous with each other through a turn-up portion, thereby forming a fourfold overlap of said first through fourth overlapping portions.

2. A belt hoist comprising a belt having a free end portion and a hook connected to said free end portion of said belt, said hook comprising a support rod around which said free end portion of said belt is wound and a holding portion for holding said support rod in sandwich, and said free end portion of said belt comprising a first coiling portion wound around said support rod in direct contact with said support rod and a second coiling portion wound around said first coiling portion of said belt in direct contact with said first coiling portion, said first and second coiling portions of said belt being wound in opposite directions forming a twofold overlap, wherein the first coiling portion and the second coiling portion are continuous with each other through a turn-up portion, wherein said belt further comprises first and second overlapping portions continuous to a first end portion and a second end portion of the first coiling portion and overlapping each other, and third and fourth overlapping portions continuous to a first end portion and a second end portion of the second coiling portion and overlapping an outside surface of the first overlapping portion and an outside surface of the second overlapping portion, respectively, the second overlapping portion and the fourth overlapping portion being continuous with each other through a turn-up portion, thereby forming a fourfold overlap of said first through fourth overlapping portions, and wherein said holding portion comprises a first holding portion for holding the fourfold overlap of the first through fourth overlapping portions in a sandwiched position, and a second holding portion for holding the support rod and the twofold overlap in a sandwiched position.

3. A belt hoist comprising a belt having a free end portion and a hook connection to said free end portion of said belt, said hook comprising a hook body, a hook's joint holding a basal end of said hook body, and a support rod around which said free end portion of said belt is wound, said hook's joint comprising two half joint bodies, an upper inside portion of each of said half joint bodies having flat-shaped first holding portions recessed with respect to confronting surfaces of said half joint bodies so as to be in contact with said free end portion of said belt, said inside portion of each of said half joint bodies also having second holding portions curving inwards from lower ends of said first holding portions so as to hold said support rod, wherein said free end portion of said belt further comprises:

a first coiling portion overlapping around a circumference of said support rod;

first and second overlapping portions being continuous to a first end portion and a second end portion of said first coiling portion, said first and second overlapping portions extending in opposite directions with respect to each other;

a second coiling portion being continuous to said second overlapping portion through a turn-up portion and winding in a direction opposite to a winding direction of said first coiling portion to overlap around a circumference of said first coiling portion; and third and fourth overlapping portions being continuous to a first end portion and a second end portion of said second coiling portion, said third and fourth overlapping portions respectively overlapping outside surfaces of said first overlapping portion and said second overlapping portion, said third and fourth overlapping portions also extending in opposite directions with respect to each other, a circumference of said second coiling portion being contacted with said second holding portions so that said second holding portions can hold said support rod in a sandwiched position, or in a clipping manner, via a twofold overlap of said first and second coiling portions, wherein said first and third overlapping portions extend in opposite directions with respect to each other, and said second and fourth overlapping portions extend in opposite directions with respect to each other, and said third and fourth overlapping portions being contacted with said first holding portions so that said first holding portions can hold a fourfold overlap of said first through fourth overlapping portions in a sandwiched position, or in a clipping manner.

4. A belt hoist comprising a belt having a free end portion and a hook connected to said free end portion of said belt, said hook comprising a support rod around which said free end portion of said belt is wound and a holding portion for holding said support rod in sandwich, and said free end portion of said belt comprising a first coiling portion wound around said support rod in direct contact with said support rod and a second coiling portion wound around said first coiling portion of said belt in direct contact with said first coiling portion, said first and second coiling portions of said belt being wound in opposite directions forming a twofold overlap, wherein the first coiling portion and the second coiling portion are continuous with each other through a turn-up portion, wherein said belt further comprises first and second overlapping portions continuous to a first end portion and a second end portion of the first coiling portion and overlapping each other, and third and fourth overlapping portions continuous to a first end portion and a second end portion of the second coiling portion and overlapping an outside surface of the first overlapping portion and an outside surface of the second overlapping portion, respectively, the second overlapping portion and the fourth overlapping portion being continuous with each other through a turn-up portion, thereby forming a fourfold overlap of said first through fourth overlapping portions, and wherein said fourfold overlap is held in a sandwiched position by said holding portion.

* * * * *